US009357802B2

(12) United States Patent
Liu

(10) Patent No.: US 9,357,802 B2
(45) Date of Patent: Jun. 7, 2016

(54) ELECTRONIC CIGARETTE CASE

(75) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 579 days.

(21) Appl. No.: 13/824,393

(22) PCT Filed: Jun. 20, 2012

(86) PCT No.: PCT/CN2012/077251

§ 371 (c)(1), (2), (4) Date: Mar. 18, 2013

(87) PCT Pub. No.: WO2013/189052

PCT Pub. Date: Dec. 27, 2013

(65) Prior Publication Data

US 2013/0342157 A1 Dec. 26, 2013

(51) Int. Cl.

| | |
|---|---|
| ***H02J 7/00*** | (2006.01) |
| ***A24F 15/18*** | (2006.01) |
| *A24F 47/00* | (2006.01) |

(52) U.S. Cl.

CPC ..... *A24F 15/18* (2013.01); *A24F 47/008* (2013.01)

(58) Field of Classification Search

USPC ..... 320/107, 112, 114

See application file for complete search history.

(56) References Cited

U.S. PATENT DOCUMENTS

| | | | | |
|---|---|---|---|---|
| 2,520,484 | A * | 8/1950 | Wax | 206/239 |
| 5,955,868 | A * | 9/1999 | Kaite et al. | 320/119 |
| 2003/0063523 | A1 * | 4/2003 | Mulaw | 368/10 |
| 2012/0227753 | A1 * | 9/2012 | Newton | 131/347 |

* cited by examiner

*Primary Examiner* — Samuel Berhanu

(74) *Attorney, Agent, or Firm* — Cheng-Ju Chiang

(57) ABSTRACT

The present invention relates to an electronic cigarette case, includes a case body, a charging device disposed in the case body for charging electronic cigarettes. The charging device includes a charging base, a rechargeable battery, and a control circuit board integrated with a circuit processing unit. The charging base has an electrode support where first and second electrode elements, and a trigger element spaced apart from the second electrode element are all disposed on the electrode support. The second electrode element is flexibly deformable when one of the electronic cigarettes is inserted into the case body to create a charging circuit. The circuit processing unit automatically controls the rechargeable battery for charging the electronic cigarette being inserted until it is full of power, whereby the electronic cigarette case is readily to be assembled and to sue, and has a reliable electrical connection with an outer power source.

12 Claims, 11 Drawing Sheets

A-A

ELECTRONIC CIGARETTE CASE

CROSS REFERENCE TO RELATED APPLICATIONS

The present application is a 35 U.S.C. §371 National Phase conversion of International (PCT) Patent Application No. PCT/CN2012/077251, filed on Jun. 20, 2012, the disclosure of which is incorporated by reference herein. The PCT International Patent Application was filed in Chinese.

BACKGROUND OF THE INVENTION

1. Field of the Invention

The present invention relates to an electronic cigarette case, and particularly to an electronic cigarette case capable of charging electronic cigarettes.

2. Related Art

Generally, an electronic cigarette case is used to store and charge electronic cigarettes. A conventional electronic cigarette case includes a case body, an electronic cigarette frame for holding power rods and inhaling rods of the electronic cigarettes, a charging apparatus having a printed circuited board (PCB) and a charging socket. The charging socket is a cylinder made of copper and having screw threads on inner surface thereof. The PCB and the charging base are coupled by welding. The power rod is screwed to the charging socket for electricity charge, and a triggering signal to charge the power rod is generated by pressing a key.

The conventional electronic cigarette case has the following drawings: process of welding the charging socket and the PCB are complex and are easily to arise the problem of short-circuit or breaking, whereby causing an unreliable connection between the PCB and the charging socket; the power rod and the charging socket are screwingly connected that is inconvenient in use; the copper material makes a high cost for manufacturing the charging socket; and the triggering signal from the key pressing is not reliable for transmission.

SUMMARY OF THE INVENTION

An object of the present invention is to provide an electronic cigarette case which is readily to be assembled and to use, and is capable of providing a reliable electrical connection, simplifying the manufacturing process, and economizing a cost of manufacturing the electronic cigarette case.

To achieve the above object, an electronic cigarette case of the present invention comprises: a case body for storing a plurality of electronic cigarettes; a charging device disposed in the case body for charging the plurality of electronic cigarettes; wherein the charging device comprises a charging base, a rechargeable battery, and a control circuit board integrated with a circuit processing unit; the charging base comprising an electrode support where a first electrode element, a second electrode element, and a trigger element spaced apart from the second electrode element at a predetermined distance are all disposed on the electrode support; two opposite ends of the first electrode element respectively electrically connected with a first electrode of one of the electronic cigarettes and a second electrode of the rechargeable battery; two opposite ends of the second electrode element respectively electrically connected with a second electrode of the one of the electronic cigarettes and a second electrode of the rechargeable battery; and the second electrode element being flexibly deformable when one of the electronic cigarettes is inserted into the case body to depress the second electrode element so as to enable the second electrode element to abut against the trigger element and create a charging circuit, wherein the circuit processing unit automatically controls the rechargeable battery for charging the one of the electronic cigarettes until it is full of power.

According to another embodiment of the present invention, the electrode support is made of an insulating material, and the first and second electrode elements each is made of a conductive metal material and bends to form a sheet-shape so as to be deformable.

According to another embodiment of the present invention, the trigger element and the first and second electrode elements are disposed in direct contact with corresponding land portions of the control circuit board, and are electrically connected with the rechargeable battery through the control circuit board.

According to another embodiment of the present invention, the electrode support comprises an upper wall, a lower wall, a left wall, a right wall, and a rear wall cooperatively forming a rectangle case shape, the trigger element is mounted to the left wall with one end of the trigger element attached to the upper wall and the other end thereof extending out of the electrode support to contact the control circuit board, the second electrode element is mounted to the right wall with one end of the second electrode element disposed above the upper wall and spaced apart at the predetermined distance from the end of the trigger element attached to the upper wall, the other end of the second electrode element extending out of the electrode support to contact the control circuit board, and the first electrode element is mounted to the rear wall with one end of the first electrode element extending out of both the upper wall of the electrode support and the second electrode element, the other end of the first electrode element extending out of the electrode support to contact the control circuit board.

According to another embodiment of the present invention, the trigger element has a main body, at least a fixing hole formed on the main body, a land contact plate that is deformable to contact the corresponding land portion of the control circuit board, and an electrode contact plate attached to the upper wall of the electrode support for contacting the second electrode element, the left wall of the electrode support having at least a positioning peg for being correspondingly mounted to the fixing hole.

According to another embodiment of the present invention, the main body and the electrode contact plate of the trigger element jointly form an L shape, and the land contact plate of the trigger element is deformable and has a U shape, V shape, or an arc shape.

According to another embodiment of the present invention, the first electrode element has a main body, at least a fastening hole formed on the main body, a land contact plate that is deformable to contact the corresponding land portion of the control circuit board, and an electrode contact plate extending out of the upper wall of the electrode support and the second electrode element for contacting the electrode of the electronic cigarette, the rear wall of the electrode support having at least a positioning peg for being correspondingly mounted to the fastening hole.

According to another embodiment of the present invention, the main body and the electrode contact plate of the first electrode element jointly form a substantially Z shape, and the land contact plate of the first electrode element is deformable and has a U shape, V shape, or an arc shape.

According to another embodiment of the present invention, the second electrode element has a main body, at least a position hole formed on the main body, a land contact plate that is deformable to contact the corresponding land portion of the control circuit board, and an electrode contact plate for contacting the electrode of the electronic cigarette and the trigger element, the right wall of the electrode support having at least a positioning peg for being correspondingly mounted to the position hole, the electrode contact plate of the second electrode element being located above the upper wall and spaced apart at the predetermined distance from the trigger element.

According to another embodiment of the present invention, the main body and the electrode contact plate of the second electrode element jointly form a substantially L shape, and the land contact plate of the second electrode element is deformable and has a U shape, V shape, or an arc shape.

According to another embodiment of the present invention, the electrode contact plate of the second electrode element is formed with a through hole for the first electrode element to pass through.

According to another embodiment of the present invention, the case body comprises a bottom case, a case cover, and a cover switch device for switchably fastening the case cover, the charging device disposed in the bottom case, the cover switch device comprising a key and a fastening element, the key which is disposed in a key hole formed on the bottom case and is engageable with the fastening element for controlling the fastening element, and the fastening element which is mounted to the bottom case and has an end portion being fastenable to an engaging slot formed on the case cover for fastening or releasing the case cover.

According to another embodiment of the present invention, the case body is provided with a first frame disposed in the case body for holding the charging device, and a second frame for guiding the plurality of electronic cigarettes to be inserted into the first frame.

According to another embodiment of the present invention, the first frame defines a guiding slot for guiding one of the plurality of electronic cigarettes to be inserted in the guiding slot, and the guiding slot has a positioning ring for positioning the one electronic cigarette.

According to another embodiment of the present invention, the case cover and/or the bottom case are made of wood by a processing technique, the wood material is selected from a natural wood group consisting of pine, redwood, padauck, rosewood, palisander, wenge, oak, walnut, maple, birch, cherrywood, shagbark, and camphor tree; the processing technique includes steps of wood chipping, wood molding, wood surface decoration, and sterilizing.

The present invention has advantages as follows: the control circuit board and the charging device are flexibly contact through a plate-like structure as described above without welding, whereby enabling simplified and convenient processes of assembly and providing a stable and reliable electrical connection.

Furthermore, components used for charging are made of metal which enables a cost down of manufacturing.

Still further, a power rod of the electronic cigarette and the charging base are capable of being electrically connected conveniently through a manner of plug and pull.

Moreover, the power rod of the electronic cigarette is triggered to be charged through a flexibly contact with the flexible plate-like structure, whereby providing a reliable connection.

DESCRIPTION OF THE PREFERRED EMBODIMENTS

Figure 1:
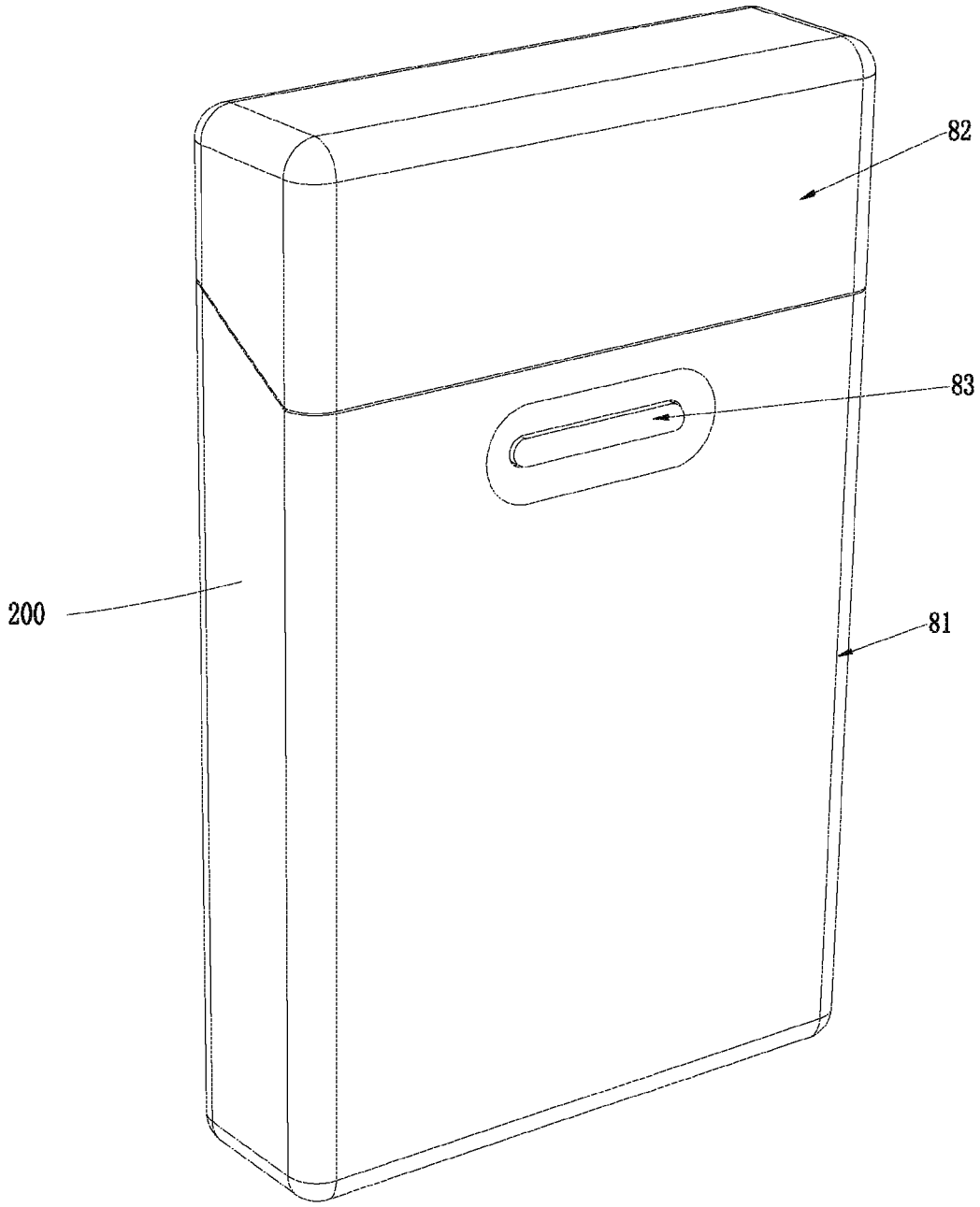
FIG. 1 is a perspective view of an electronic cigarette case of the present invention.

As shown in FIGS. 1 to 13, an embodiment of the present invention is to provide an electronic cigarette case 200 for storing a plurality of electronic cigarettes 100 each having an inhaling rod 90 and a power rod 91, and for charging the power rod 91. The electronic cigarette case 200 comprises a case body having a bottom case 81, a case cover 82 corresponding to the bottom case 81, and a cover switch device 83, and a charging device 7 installed with a rechargeable battery 71 for the power rod 91 of the electronic cigarette 100.

Figure 2:
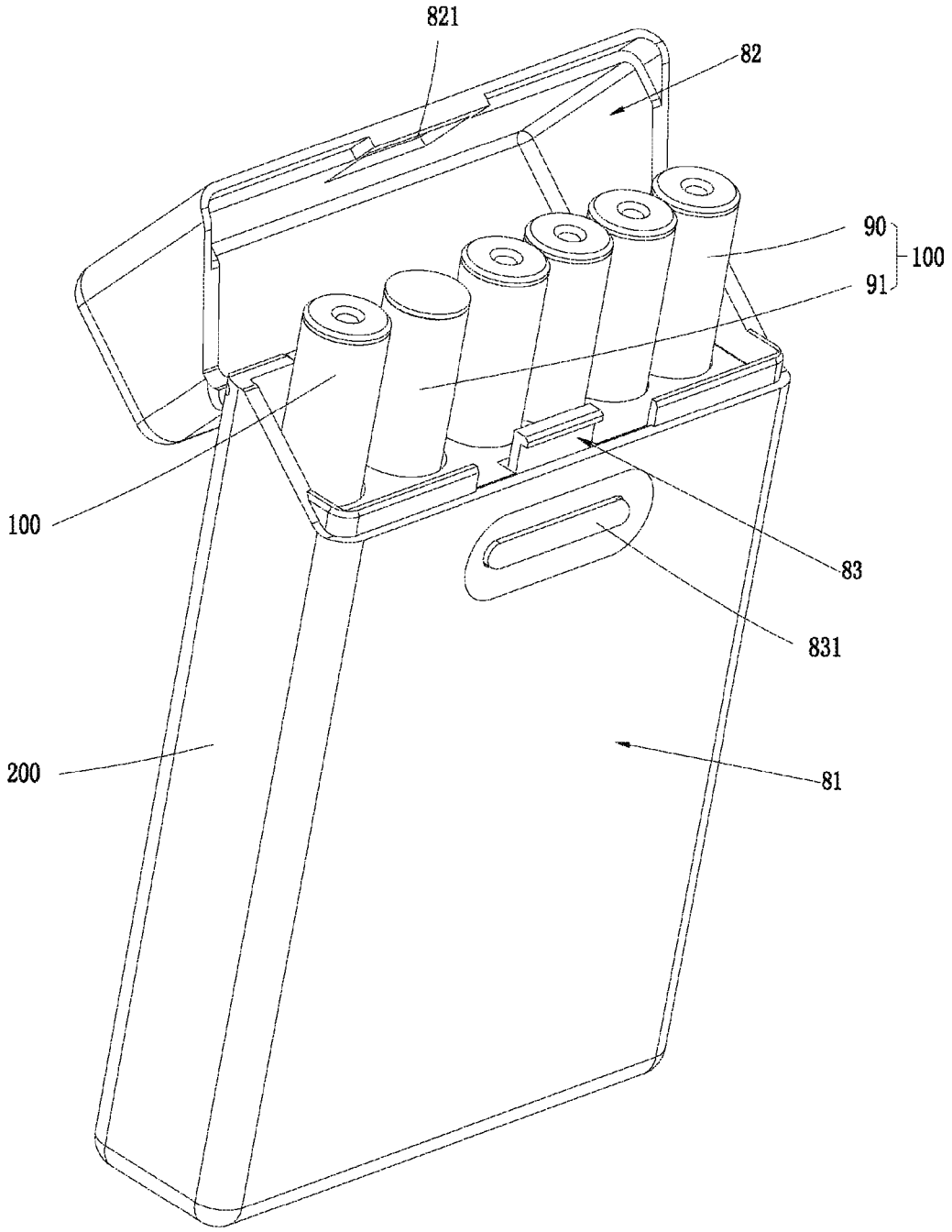
FIG. 2 is a schematic view showing a use state of the electronic cigarette case of the present invention.
Figure 3:
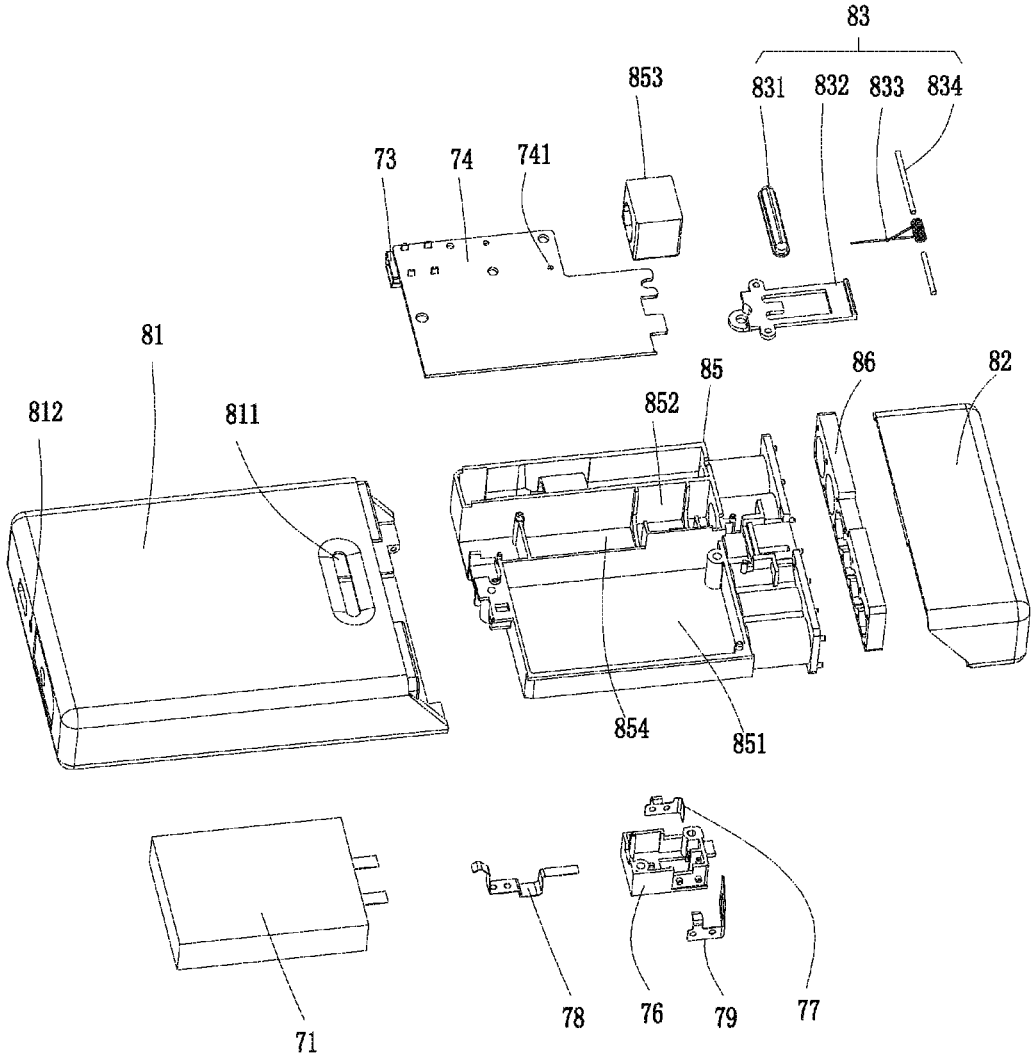
FIG. 3 is an exploded view of the electronic cigarette case of the present invention.
Figure 4:
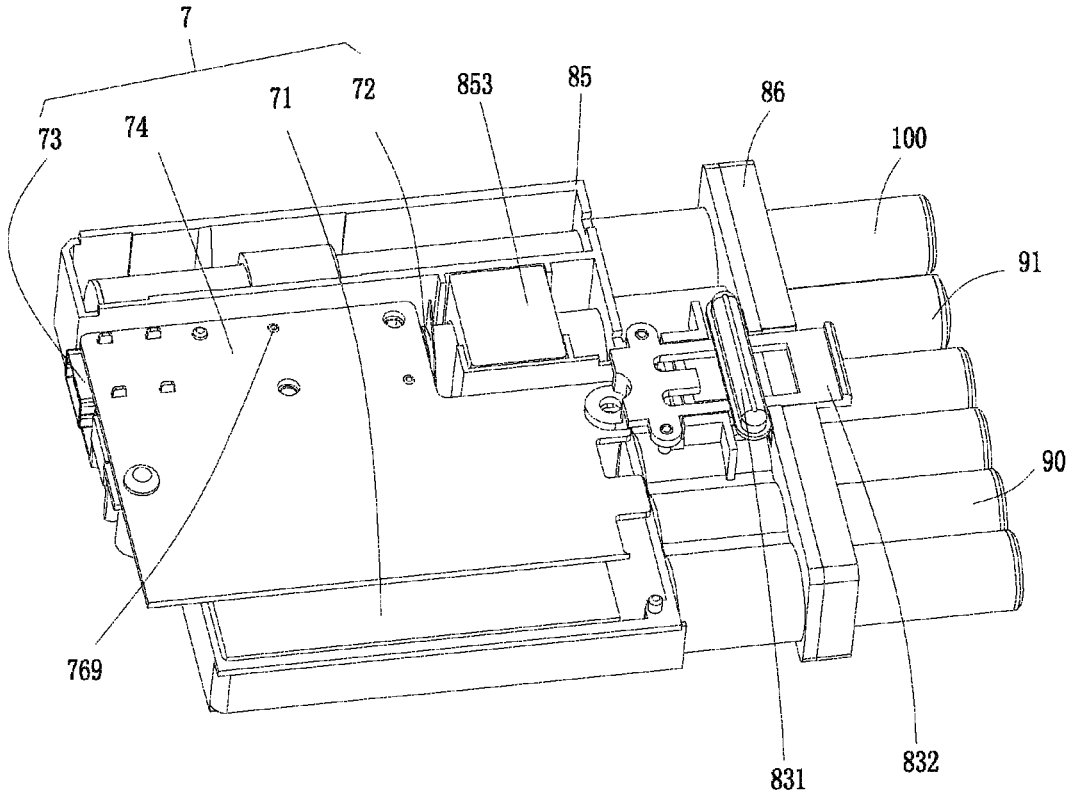
FIG. 4 is the electronic cigarette case of FIG. 2 without an outer case.

As shown in FIGS. 1 and 2, the bottom case 81 is a rectangular casing, but the shape thereof is not limited thereby, and can alternatively be round, oval, or polygon. The case cover 82 has a shape corresponding to the bottom case 81. The bottom case 81 is provided with a first frame 85 disposed in the bottom case 81 for holding the charging device 7, and a second frame 86 for guiding and supporting the plurality of electronic cigarettes 100. The bottom case 81 defines a key hole 811 thereon (as shown in FIG. 3), and a bottom of the bottom case 81 is provided with an indicator light 812 for indicating whether the rechargeable battery 71 is full of power.

The case cover 82 is pivotally installed to the bottom case 81 under control of a cover switch device 83. The cover switch device 83 comprises a key 831, a fastening element 832 being fastenable to the case cover 82, a return spring 833 for automatically returning a position of the case cover 82, and a pivot shaft 834. The fastening element 832 is mounted onto the first frame 85 and made of a flexible plastic that is flexibly deformable. The key 831 disposed in the key hole 811 is fixed on the fastening element 832 and extends out of the bottom case 81. The key 831 is installed in the key hole 811 disposed on the bottom case 81, and engages with the fastening element 832 for controlling the fastening element 832. The fastening element 832 is mounted in the bottom case 81 and has an end portion being fastenable to an engaging slot 821 formed on the case cover 82 for fastening or releasing the case cover 82 from the bottom case 81. The case cover 82 is pivotally coupled with the bottom case 81 through the pivot shaft 834. The return spring 833 has two end portions, wherein one end portion abuts against the bottom case 81 and the other end portion is mounted to the pivot shaft 834 and abuts against the case cover 82. When the case cover 82 completely covers one end of the bottom case 81, the return spring 833 is therefore deformed and produces a store energy for being used to open the case cover 82.

The first frame 85 is disposed in the case body 81 and forms a battery slot 851, the rechargeable battery 71 being disposed in the battery slot 851. The first frame 85 is made of metal or plastic material and further defines a guiding slot 852 for guiding the power rod 91. The guiding slot 852 has a positioning ring 853 for tightly positioning the power rod 91 in the first frame 85. The positioning ring 853 is made of a flexible plastic material and forms a positioning hole therein which penetrates a middle portion of the positioning ring 853, the positioning ring 853 is fixed in the guiding slot 852. The first frame 85 is further provided with an inserting groove 854 communicating with the guiding slot 852.

The second frame 86 is mounted in the bottom case 81 and located above the first frame 85 for guiding and supporting the plurality of electronic cigarettes 100, the second frame 86 being made of a flexible plastic material.

Figure 5:
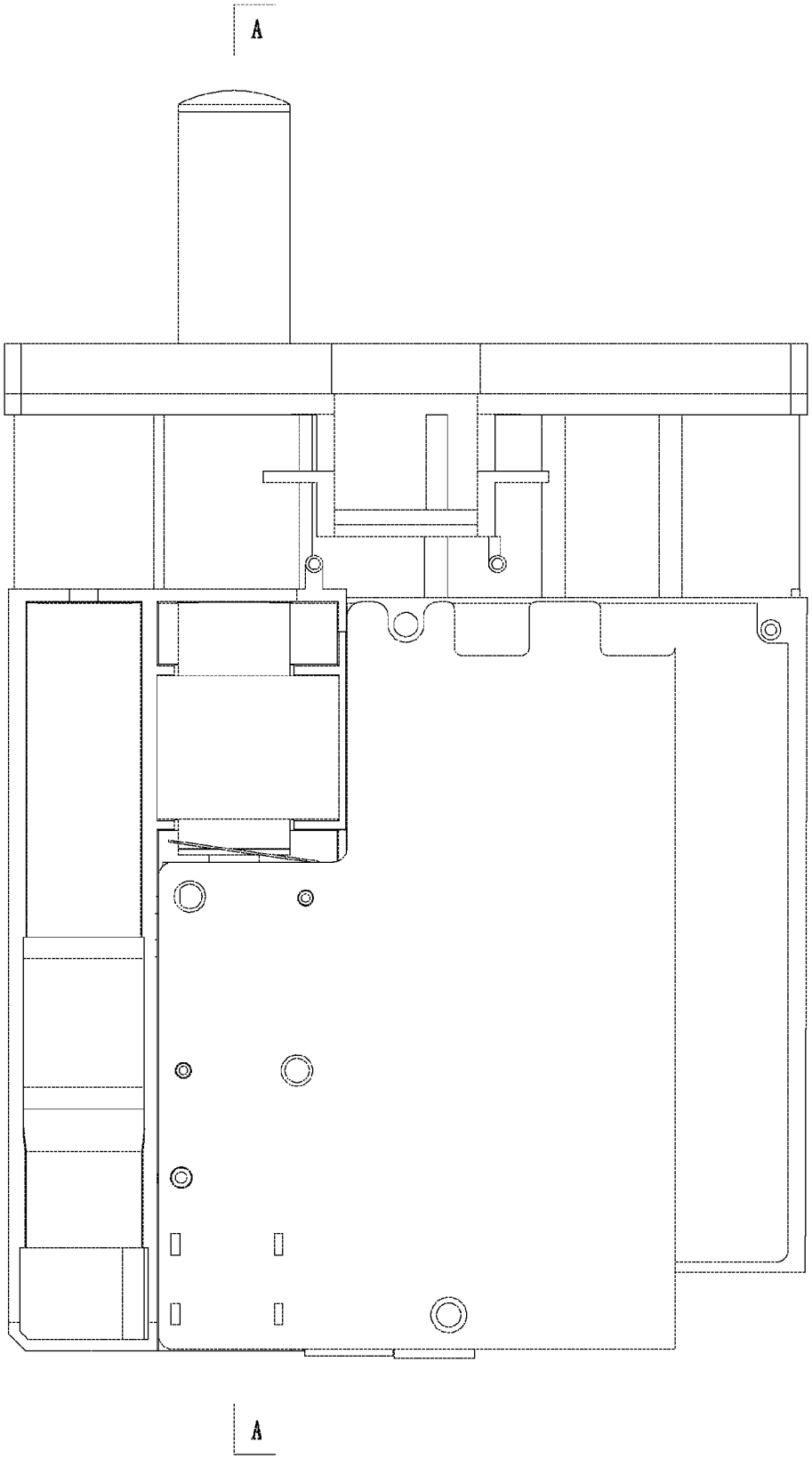
FIG. 5 is a front elevational view of FIG. 4.

As shown in FIG. 5, the charging device 7 is disposed in the bottom case 81 and comprises the rechargeable battery 71, a charging base 72, and a USB socket 73 for input of an external power source that are all connected to a circuit processing unit. In this embodiment, the charging device 7 further comprises a control circuit board 74 integrated with the USB socket 73 and the circuit processing unit. The control circuit board 74 forms assembling holes 741 for assembling the charging base 72, and is mounted onto the first frame 85. The USB socket 73 is intended to be connected with the external power source so as to supply electricity to the rechargeable battery 71. However, the socket 73 is not only limited to be the USB interface; other types of socket interfaces are available to use for receiving an external power source.

The charging device 7 further comprises an electrode support 76 and a trigger element 77, a first electrode element 78 and a second electrode element 79 that are respectively mounted to the electrode support 76. In this embodiment, the second electrode element 79 and the trigger element 77 cooperatively function as a knife-type switch.

Figure 8:
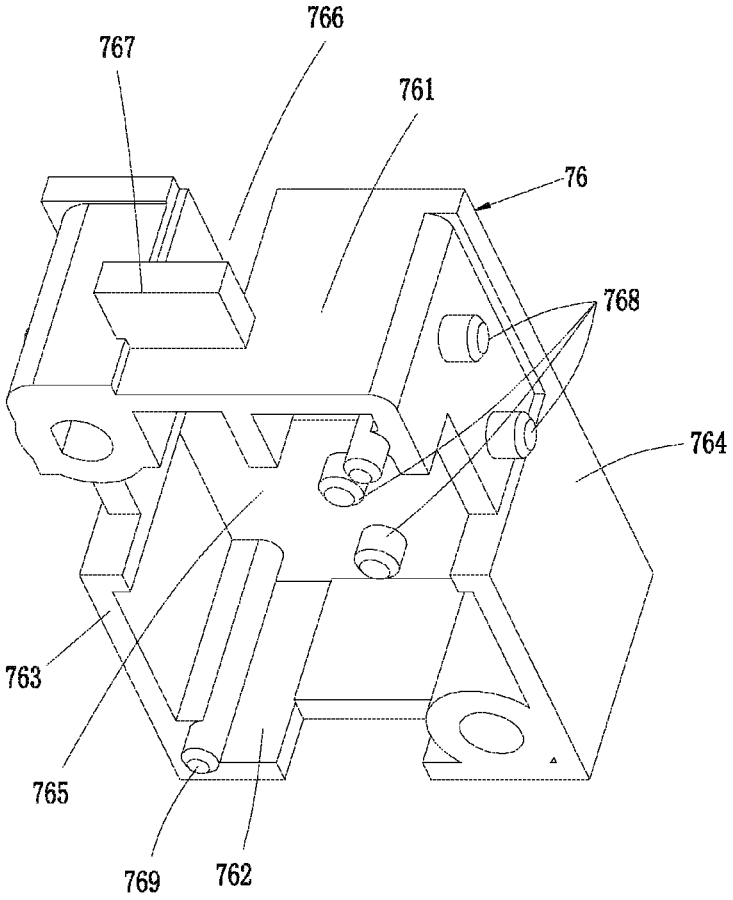
FIG. 8 is a perspective view of an electrode support of the electronic cigarette case of the present invention.
Figure 13:
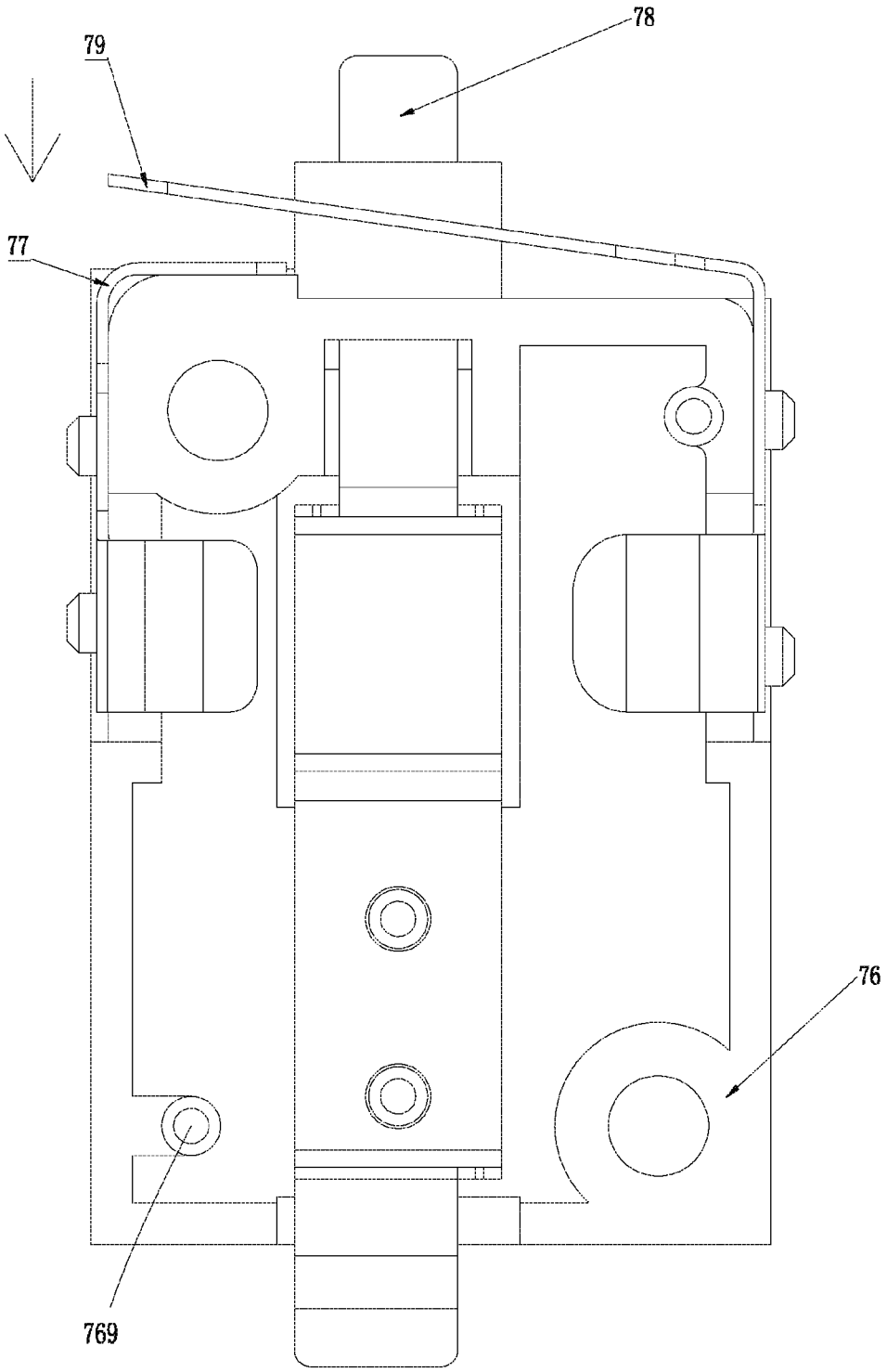
FIG. 13 is a front elevational view of the charging base of the electronic cigarette case of the present invention.

As shown in FIG. 8 depicting a direction for direction-related words described hereinafter, the electrode support 76 is being substantially internal hollow and has a structure having a slot-like shape. The electrode support 76 is made of an insulating material such as, for example, a plastic material, and comprises an upper wall 761, a lower wall 762, a left wall 763, a right wall 764, and a rear wall 765 cooperatively forming a rectangle case shape for supporting the first electrode element 78. The upper wall 761 defines a passage 766 and a limiting block 767 which is intended to limit an insertion depth of the power rod 91. The right wall 764 has two positioning pegs 768 for fixing the second electrode element 79, wherein the number of the positioning pegs 768 is not limited thereby. Correspondingly, the left wall 763 also has two positioning pegs 768 (as shown in FIG. 13) for fixing the trigger element 77. The rear wall 765 also has two positioning pegs 768 for fixing the first electrode element 78. The electrode support 76 has a plurality of insertion pegs 769 for enabling the electrode support 76 to be mounted to the control circuit board 74. In this embodiment, two opposite corners of the rectangle slot shaped electrode support 76 are provided with two the insertion pegs 769 for being mounted to the corresponding assembling holes 741 of the control circuit board 74, thereby the electrode support 76 is mounted to the control circuit board 74 through the insertion pegs 769.

Figure 9:
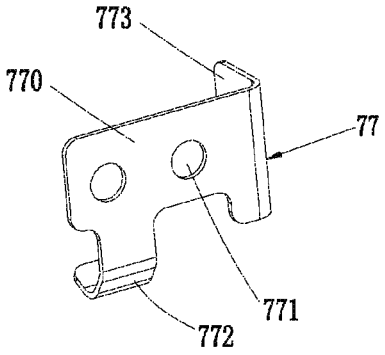
FIG. 9 is a perspective view of a trigger element of the electronic cigarette case of the present invention.

As shown in FIG. 9, the trigger element 77 functions as a contact point of a knife-type switch and is intended to contact an electrode of the rechargeable battery 71. In this embodiment, the trigger element 77 is formed by bending a metal sheet as a negative electrode plate, and is directly connected to a negative land portion provided on the control circuit board 74, and further electrically contacts the rechargeable battery 71 through the control circuit board 74. The trigger element 77 has a main body 770 for being mounted to the electrode support 76, two fixing holes 771 formed on the main body 770 for being mounted to the corresponding positioning pegs 768, a land contact plate 772 that is deformable to contact a corresponding negative land portion of the control circuit board 74, and an electrode contact plate 773 for contacting the second electrode element 79. The main body 770 and the electrode contact plate 773 of the trigger element 77 jointly form an L shape. The land contact plate 772 is deformable and has a U shape, V shape, or an arc shape.

Figure 10:
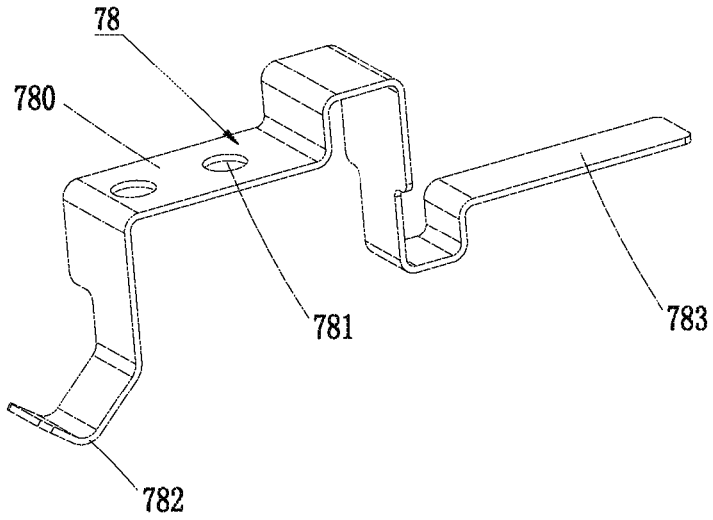
FIG. 10 is a perspective view of a first electrode element of the electronic cigarette case of the present invention.

As shown in FIG. 10, in this embodiment, the first electrode plate 78 is made of metal sheet and is intended to connect the positive electrode of the power rod 91 and a corresponding land portion of the control circuit board 74. The first electrode element 78 has a main body 780 for being mounted to the electrode support 76, two fastening holes 781 formed on the main body 780 for being mounted to the corresponding positioning pegs 768, a land contact plate 782 that is deformable to contact a corresponding positive land portion of the control circuit board 74, and an electrode contact plate 783 that is deformable to contact the positive electrode of the power rod 91. The main body 780 and the electrode contact plate 783 of the first electrode element 78 jointly form a substantially Z shape. The land contact plate 782 is deformable and has a U shape, V shape, or an arc shape.

Figure 11:
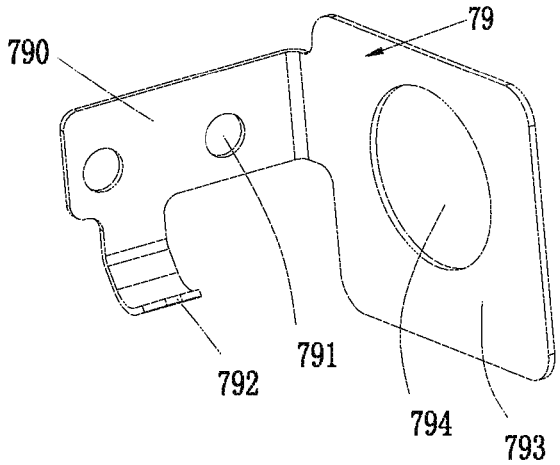
FIG. 11 is a perspective view of a second electrode element of the electronic cigarette case of the present invention.

As shown in FIG. 11, in this embodiment, the second electrode plate 79 is made of metal sheet and is intended to connect a negative electrode of the power rod 91 and a corresponding land portion of the control circuit board 74. The second electrode element 79 has a main body 790 for being mounted to the electrode support 76, two position holes 791 formed on the main body 790 for being mounted to the corresponding positioning pegs 768, a land contact plate 792 that is deformable to contact a corresponding negative land portion of the control circuit board 74, an electrode contact plate 793 that is deformable to contact both of the negative electrode of the power rod 91 and the trigger element 77, and a through hole 794 formed on the electrode contact plate 793. The main body 790 of the second electrode element 79 and the electrode contact plate 793 jointly form a substantially L shape. The land contact plate 792 is deformable and has a U shape, V shape, or an arc shape.

Figure 12:
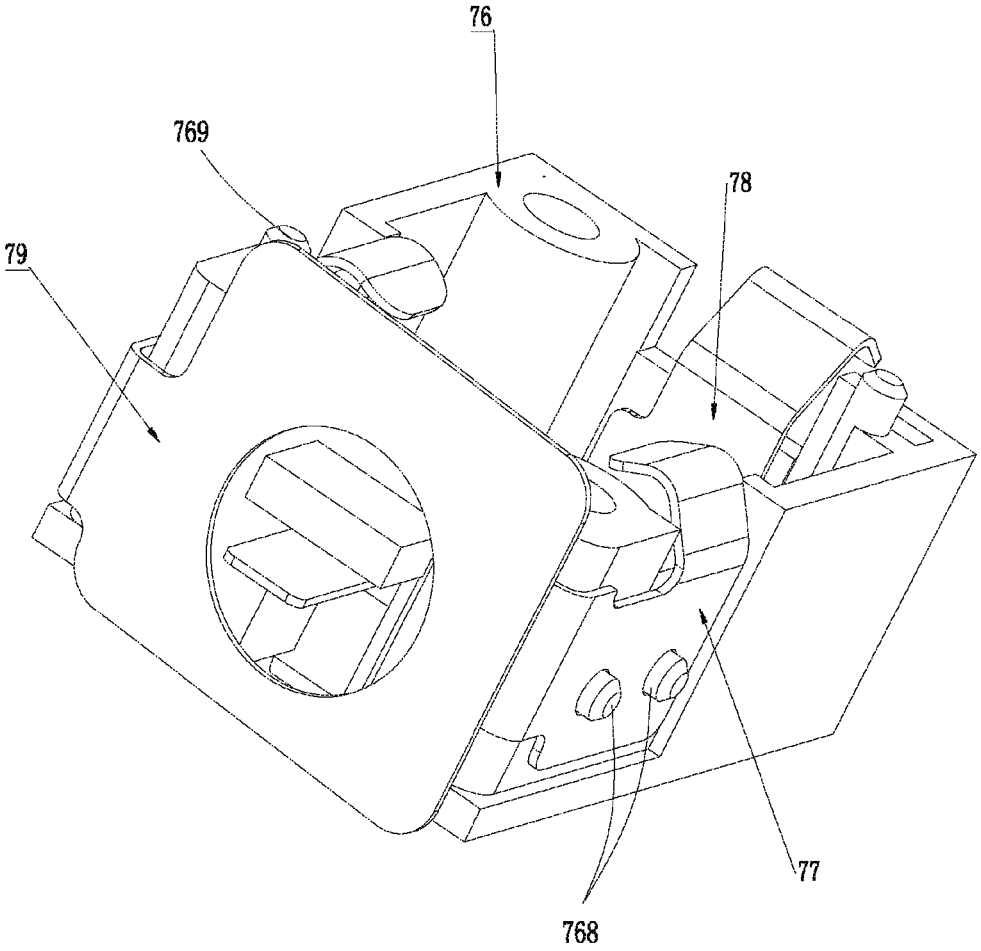
FIG. 12 is a perspective view of a charging base of the electronic cigarette case of the present invention.

As shown in FIGS. 11 and 12, the trigger element 77, the first electrode element 78 and the second electrode element 79 are all mounted to the electrode support 76, and the electrode support 76 is mounted to the inserting groove 854 (as shown in FIG. 3), with the insertion pegs 769 fixed onto the control circuit board 74. The trigger element 77 is mounted and attached to the left wall 763 of the electrode support 76, wherein the electrode contact plate 773 of the trigger element 77 is attached to the upper wall 761. The electrode contact plate 783 of the first electrode element 78 passes through the passage 766 and the through hole 794 and extends out of the second electrode element 79, wherein the electrode contact plate 783 is not in contact with the electrode contact plate 793 of the second electrode element 79 so as to prevent from causing a short-circuit. The second electrode element 79 is mounted and attached to the right wall 764 of the electrode support 76. The electrode contact plate 793 of the second electrode element 79 is disposed above the upper wall 761 and not in contact with the electrode contact plate 773 of the trigger element 77.

Figure 6:
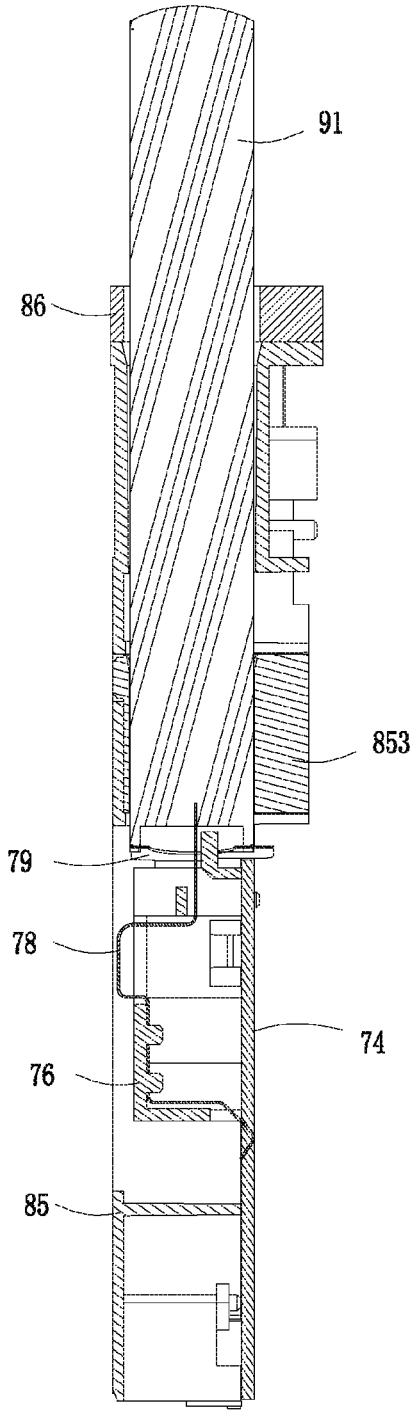
FIG. 6 is a cross-sectional view taken along line A-A of FIG. 5.
Figure 7:
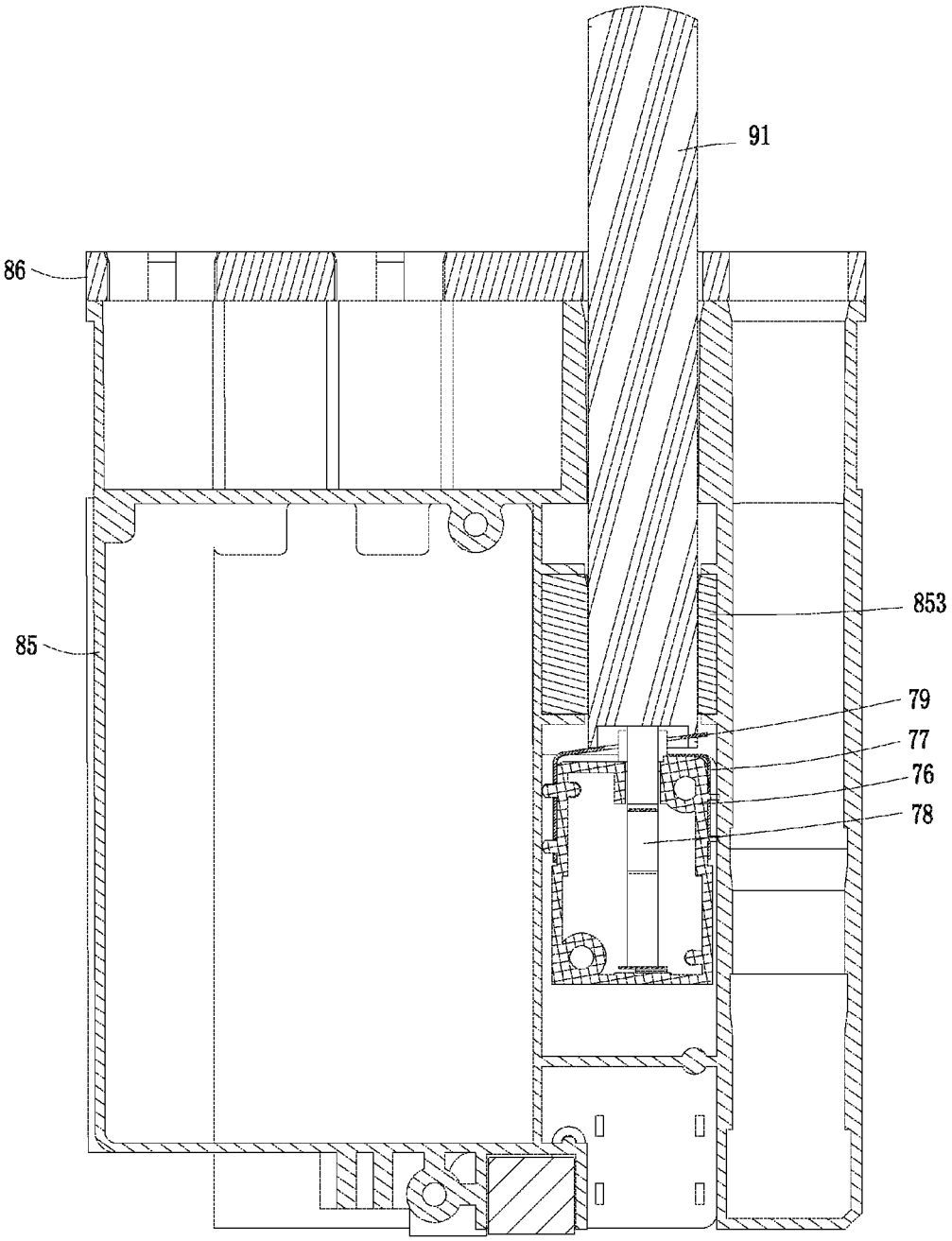
FIG. 7 is a cross-sectional view of FIG. 5 in a transversal direction thereof.

In this embodiment, the power rod 91 defines an insertion end at one end thereof for being inserted into the case body where an internal portion of the insertion end is defined as a first electrode which is capable of flexibly contacting the electrode contact plate 783 of the first electrode element 78 in order to create an electrical connection with the electrode contact plate 783. An end surface of the insertion end of the power rod 91 is defined as a second electrode which is capable of flexibly contacting the electrode contact plate 793 of the second electrode element 79 in order to create an electrical connection with the electrode contact plate 793 (as shown in FIGS. 6 and 7). The land contact plate 772 of the trigger element 77, the land contact plate 782 of the first electrode element 78, and the land contact plate 792 of the second electrode element 79 respectively electrically contact the corresponding land portions of the control circuit board 74. Such a way of flexibly contact through a plate-like structure as described above is performed without welding, whereby enabling simplified and convenient processes of assembly and providing a stable and reliable electrical connection. The trigger element 77 functioning as a switch to trigger the power rod 91 is performed through flexibly contact so as to provide a reliable connection.

In this embodiment, the charging base 72 comprises the electrode support 76, the first electrode element 78, the second electrode element and the trigger element 77, wherein the trigger element 77 and the second electrode piece element 79 cooperatively operate as a power switch. When the power rod 91 is inserted into the charging base 72, the power rod 91 depresses the electrode contact plate 793 of the second electrode element 79, whereby the electrode contact plate 793 is deformed and bends to electrically contact the electrode contact plate 773 of the trigger element 77. The trigger element 77 electrically connects the rechargeable battery 71 so as to allow the rechargeable battery 71 to charge the power rod 91, and is capable of automatically interrupting charging when the electricity of the power rod 91 is full. Because the power rod 91 is connected with the charging base 72 in such a manner of plug and pull, the power rod 91 and the charging base 72 are capable of being assembled and used conveniently. By comparison with the conventional charging socket made of a copper cylinder, the charging base 72 of present invention made of the metal sheet is capable of economizing the manufacturing cost.

The bottom case 81 and/or the case cover 82 are capable of being made of a metal or plastic material.

According to another embodiment, the bottom case 81 and/or the case cover 82 are made of wood so as to beautify an appearance of the electronic cigarette case and improve the holding feeling, and further to lower manufacturing cost and be more environmentally friendly. The wood material is selected from a natural wood group consisting of pine, redwood, padauck, rosewood, palisander, wenge, oak, walnut, maple, birch, cherrywood, shagbark, and camphor tree; the processing technique includes steps of wood chipping, wood molding, wood surface decoration, and sterilizing.

It is understood that the invention may be embodied in other forms within the scope of the claims. Thus the present examples and embodiments are to be considered in all respects as illustrative, and not restrictive, of the invention defined by the claims.

What is claimed is:

1. An electronic cigarette case, comprising:

a case body for storing a plurality of electronic cigarettes;

a charging device disposed in the case body for charging the plurality of electronic cigarettes;

wherein the charging device comprises a charging base, a rechargeable battery, and a control circuit board integrated with a circuit processing unit; the charging base comprising an electrode support where a first electrode element, a second electrode element, and a trigger element spaced apart from the second electrode element at a predetermined distance are all disposed on the electrode support; two opposite ends of the first electrode element respectively electrically connected with a first electrode of one of the electronic cigarettes and a first electrode of the rechargeable battery; two opposite ends of the second electrode element respectively electrically connected with a second electrode of the one of the electronic cigarettes and a second electrode of the rechargeable battery; and the second electrode element being flexibly deformable when one of the electronic cigarettes is inserted into the case body to depress the second electrode element so as to enable the second electrode element to abut against the trigger element and create a charging circuit, wherein the circuit processing unit automatically controls the rechargeable battery for charging the electronic cigarette being inserted until it is full of power;

the electrode support is made of an insulating material, and the first and second electrode elements each is made of a conductive metal material and bends to form a sheet-shape so as to be deformable;

the trigger element and the first and second electrode elements are disposed in direct contact with corresponding land portions of the control circuit board, and are electrically connected with the rechargeable battery through the control circuit board;

the electrode support comprises an upper wall, a lower wall, a left wall, a right wall, and a rear wall cooperatively forming a rectangle case shape, the trigger element is mounted to the left wall with one end of the trigger element attached to the upper wall and the other end thereof extending out of the electrode support to contact the control circuit board, the second electrode element is mounted to the right wall with one end of the second electrode element disposed above the upper wall and spaced apart at the predetermined distance from the end of the trigger element attached to the upper wall, the other end of the second electrode element extending out of the electrode support to contact the control circuit board, and the first electrode element is mounted to the rear wall with one end of the first electrode element extending out of both the upper wall of the electrode support and the second electrode element, the other end of the first electrode element extending out of the electrode support to contact the control circuit board.

2. The electronic cigarette case of claim 1, wherein the trigger element has a main body, at least a fixing hole formed on the main body, a land contact plate that is deformable to contact the corresponding land portion of the control circuit board, and an electrode contact plate attached to the upper wall of the electrode support for contacting the second electrode element, the left wall of the electrode support having at least a positioning peg for being correspondingly mounted to the at least one fixing hole.

3. The electronic cigarette case of claim 2, wherein the main body and the electrode contact plate of the trigger element jointly form an L shape, and the land contact plate of the trigger element is deformable and has a U shape, V shape, or an arc shape.

4. The electronic cigarette case of claim 1, wherein the first electrode element has a main body, at least a fastening hole formed on the main body, a land contact plate that is deformable to contact the corresponding land portion of the control circuit board, and an electrode contact plate extending out of the upper wall of the electrode support and the second electrode element for contacting the first electrode of the electronic cigarette, the rear wall of the electrode support having at least a positioning peg for being correspondingly mounted to the at least one fastening hole.

5. The electronic cigarette case of claim 4, wherein the main body and the electrode contact plate of the first electrode element jointly form a substantially Z shape, and the land contact plate of the first electrode element is deformable and has a U shape, V shape, or an arc shape.

6. The electronic cigarette case of claim 1, wherein the second electrode element has a main body, at least a position hole formed on the main body, a land contact plate that is deformable to contact the corresponding land portion of the control circuit board, and an electrode contact plate for contacting the second electrode of the electronic cigarette and the trigger element, the right wall of the electrode support having at least a positioning peg for being correspondingly mounted to the at least one position hole, the electrode contact plate of the second electrode element being located above the upper wall and spaced apart at the predetermined distance from the trigger element.

7. The electronic cigarette case of claim 6, wherein the main body and the electrode contact plate of the second electrode element jointly form a substantially L shape, and the land contact plate of the second electrode element is deformable and has a U shape, V shape, or an arc shape.

8. The electronic cigarette case of claim 6, wherein the electrode contact plate of the second electrode element is formed with a through hole for the first electrode element to pass through.

9. The electronic cigarette case of claim 1, wherein the case body comprises a bottom case, a case cover, and a cover switch device for switchably fastening the case cover, the charging device disposed in the bottom case, the cover switch device comprising a key and a fastening element, the key which is disposed in a key hole formed on the bottom case and is engageable with the fastening element for controlling the fastening element, and the fastening element which is mounted to the bottom case and has an end portion being fastenable to an engaging slot formed on the case cover for fastening or releasing the case cover.

10. The electronic cigarette case of claim 1, wherein the case body is provided with a first frame disposed in the case body for holding the charging device, and a second frame for guiding the plurality of electronic cigarettes to be inserted into the first frame.

11. The electronic cigarette case of claim 10, wherein the first frame defines a guiding slot for guiding one of the plurality of electronic cigarettes to be inserted in the guiding slot, and the guiding slot has a positioning ring for positioning the one electronic cigarette.

12. The electronic cigarette case of claim 1, wherein the case cover and/or the bottom case are made of wood by a processing technique, the wood material is selected from a natural wood group consisting of pine, redwood, padauck, rosewood, palisander, wenge, oak, walnut, maple, birch, cherrywood, shagbark, and camphor tree; the processing technique includes steps of wood chipping, wood molding, wood surface decoration, and sterilizing.

* * * * *